US007798489B2

(12) United States Patent
Baena, Jr. et al.

(10) Patent No.: US 7,798,489 B2
(45) **Date of Patent: *Sep. 21, 2010**

(54) MEDIA HANDLING SYSTEM FOR LOWERING AND RAISING STACK PLATFORM RESPONSIVE TO MOVING BIN BETWEEN EXTERNAL AND INTERNAL POSITIONS

(75) Inventors: Douglas Andagan Baena, Jr., Dumaguete (PH); Moneleo De Castro Cedeno, Iligan (PH); Daniel Paul Cahill, Verona, KY (US); William Paul Cook, Lexington, KY (US); Edward Lynn Triplett, Lexington, KY (US); Jason Lee Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/192,592

(22) Filed: Aug. 15, 2008

(65) Prior Publication Data

US 2010/0038846 A1 Feb. 18, 2010

(51) Int. Cl.
*B65H 31/10* (2006.01)

(52) U.S. Cl. ..... 271/217; 271/157; 187/262; 187/414; 248/330.1

(58) Field of Classification Search ..... 271/152, 271/153, 154, 157, 147, 213, 214, 215, 217; 187/261, 262, 414; 248/329, 330.1
See application file for complete search history.

(56) References Cited

U.S. PATENT DOCUMENTS 1,567,783 A * 12/1925 Best ..... 242/376
4,718,658 A * 1/1988 Hirose et al. ..... 271/258.04
5,054,162 A * 10/1991 Rogers ..... 242/376
7,686,293 B2 * 3/2010 Baena et al. ..... 271/160

FOREIGN PATENT DOCUMENTS

DE 4105901 A * 8/1992

* cited by examiner

*Primary Examiner*—Gene Crawford
*Assistant Examiner*—Gerald W McClain
(74) *Attorney, Agent, or Firm*—John Victor Pezdek

(57) ABSTRACT

A media handling system for an image forming machine includes a stationary frame, a platform supporting a stack of media sheets thereon, a bin supporting the platform and in turn supported on the stationary frame for undergoing movement relative thereto between a first position in which the bin locates the platform below and aligned with a pick mechanism and movable relative to the bin toward and away from the pick mechanism and a second position in which the bin displaces the platform away from and out of alignment with the pick mechanism, and a motion transmitting assembly coupled between the stationary frame, platform and bin and operable to convert movement of the bin between first and second positions relative to the stationary frame into movement of the platform relative to the bin toward and away from the pick mechanism.

2 Claims, 8 Drawing Sheets

MEDIA HANDLING SYSTEM FOR LOWERING AND RAISING STACK PLATFORM RESPONSIVE TO MOVING BIN BETWEEN EXTERNAL AND INTERNAL POSITIONS

CROSS REFERENCE TO RELATED APPLICATION

This patent application is related to co-pending U.S. patent application Ser. No. 12/192,556 entitled "Media Handling System For Maintaining Stack Top Within Given Range Of Pick Positions During Feeding Sheets From Stack Top", assigned to the assignee of the present invention, and filed concurrently with the subject application.

BACKGROUND

1. Field of the Invention

The present invention relates generally to an image forming machine and, more particularly, to a media handling system for lowering and raising a platform in a bin in response to moving the bin between external and internal positions of the system.

2. Description of the Related Art

To feed a large amount of media sheets from a media handling system to an image forming machine without interruption, there is a first operational requirement to maintain the top of the large stack of media sheets, for instance, a stack of greater than 500 sheets, within a given range of pick positions in which a pick mechanism supported on the frame of the machine operates. This will enable a feed roll of the pick mechanism to reach and individually pick the top sheet from the stack and feed it to the image forming machine or to an intermediate module that feeds the picked sheet to the machine. To accommodate this first operational requirement in the media handling system a platform typically is provided in a movable bin. The platform is mounted to the bin so as to undergo vertical movement relative to the bin and toward and away from the pick mechanism located above the bin. Also, there is a second operational requirement that the bin itself be mounted to the frame of the machine to undergo horizontal sliding movement out of and into the machine between a reload position located externally of the frame and the sheet pick position located internally of the frame in order to periodically replenish the supply of media sheets stacked on the platform in the bin. Further, there is a third operational requirement that the components of the media handling system accommodate a range of different media types and weights.

It can easily be realized that the first two operational requirements could come into conflict when the bin needs to be moved from the internal sheet pick position to the external sheet reload position. The top of the stack on the platform or the platform itself when disposed within the given range of pick positions in which the pick mechanism operates may be close enough to cause interference with components of the pick mechanism should the bin be moved away from the frame of the machine without first relocating the platform downward away from the pick mechanism. Thus, there is a need to ensure that the platform will be maintained within a desired range of elevations or levels to keep the top of the stack within the given range of pick positions that the pick mechanism operates in while at the same time ensure that the platform will be automatically lowered to remove the top of the stack below the range of pick positions wherever the bin is moved to the external reload position away from the pick mechanism of the machine. In addition, it can easily be realized that this need must be resolved in a way that allows the system to satisfy the third operational requirement, the applicability of its components to an acceptable range of different media types and weights.

A resolution of this need could readily be found if there were only modest limitations on the cost of mechanisms that could be used to fulfill all of these operational requirements. However, given the competitive market environment that exists in the field of image forming machines, rather stringent cost limitations continue to be imposed on product innovations. Feasible solutions are only those that add minimal cost to these machines while still accommodating a range of different media types and weights. Some prior art approaches are applicable only to machines that are dedicated to a single or very limited range of media types and weights. Other prior art approaches require the use of high-capacity motors with built-in power supplies that are too high in cost to implement and so are not considered to offer feasible solutions that meet these operational requirements in the current competitive environment.

Thus, there is still a need for an innovation that will resolve the potential conflict between the aforementioned operational requirements under the restrictive cost limitations imposed on product innovations.

SUMMARY OF THE INVENTION

The present invention and the invention of the above cross-referenced patent application meet this need by providing innovations that resolve in a cost-effective manner any potential conflict between maintaining the top of the stack within a given range of operating positions for performance of sheet feeding, lowering the top of the stack below such range concurrently as the bin supporting the platform is moved to an external reload position, and retaining applicability of the system to an acceptable range of media types and weights. The innovations underlying the present invention and the invention of the cross-referenced patent application involve the employment of relatively low-cost mechanical components and a low-cost low-torque drive motor in motion transmitting assemblies and a plurality of relatively low-cost sensor components, that do not require the addition of high-capacity motors nor built-in power supplies, to assist them in periodically lifting the large stack of media sheets to maintain the top of the stack within the given range of operating positions for performance of sheet feeding, in periodically lowering the platform within the bin to avoid interference between the stack top or platform and other components when the bin is moved from the internal operating or feeding position to the external reloading position, in resisting downward force on the stack top during performance of sheet feeding, and in accommodating different media types and weights within a given acceptable range.

Accordingly, in an aspect of the present invention, a media handling system for an image forming machine includes a stationary frame, a platform for supporting a stack of media sheets thereon, a bin movably supporting the platform and in turn supported on the stationary frame for undergoing movement relative to the stationary frame between a first position in which the bin locates the platform below and aligned with a sheet feeding position and movable relative to the bin toward and away from the sheet feeding position and a second position in which the bin displaces the platform away from and out of alignment with the sheet feeding position, and a motion transmitting assembly coupled between the stationary frame, platform and bin and operable to convert movement of the bin between the first and second positions relative to the stationary frame into movement of the platform relative to the bin toward and away from the sheet feeding position.

BRIEF DESCRIPTION OF THE DRAWINGS

Figure 1:
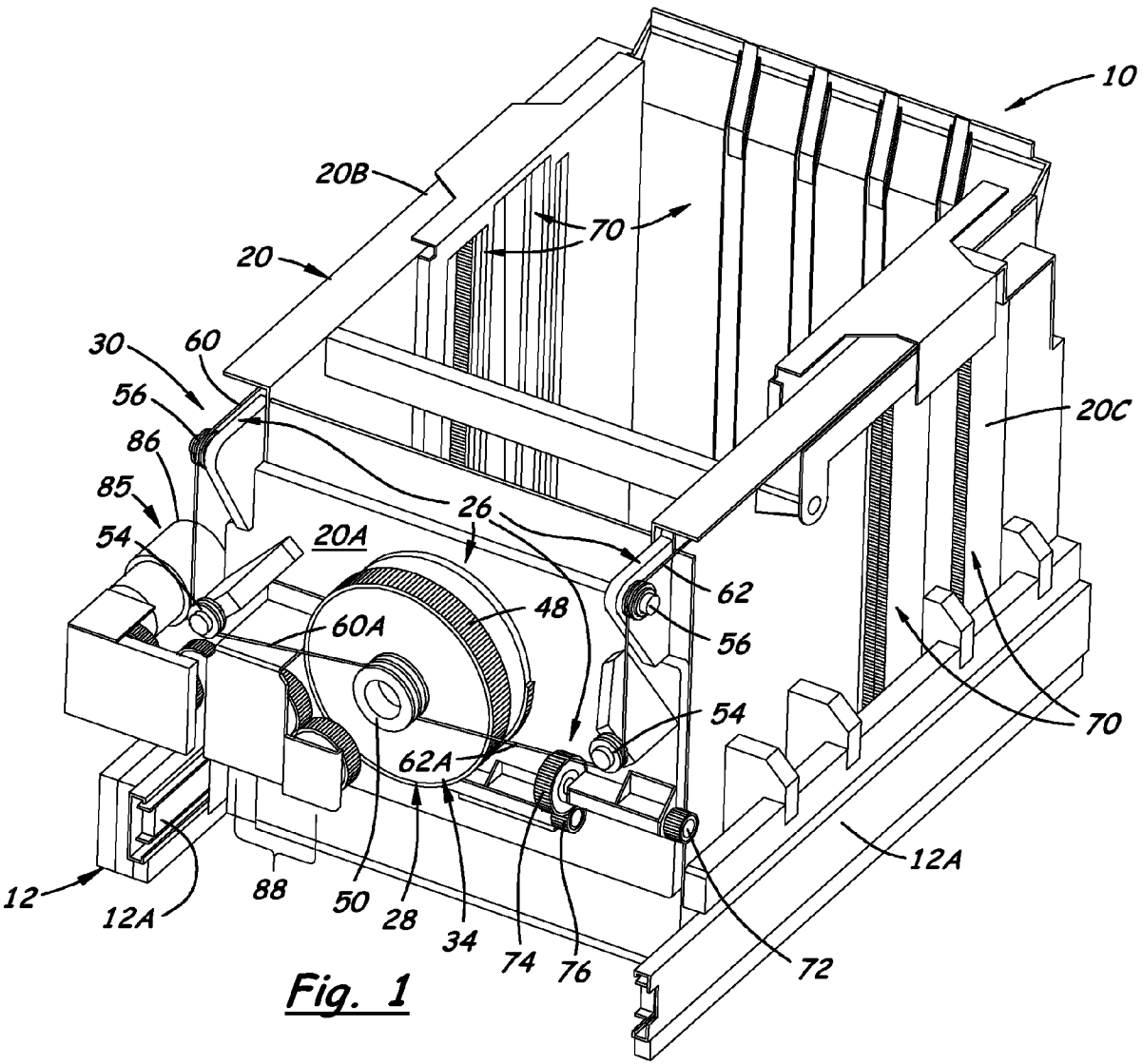

Having thus described the invention in general terms, reference will now be made to the accompanying drawings, which are not necessarily drawn to scale, and wherein:

FIG. 1 is a schematic representation of a media handling system for lowering and raising a platform thereof responsive to sliding a bin thereof between external and internal positions in accordance with the present invention and for raising the platform with reference to a sheet feeding mechanism (not shown) in accordance with the invention of the cross-reference patent application.

Figure 2:
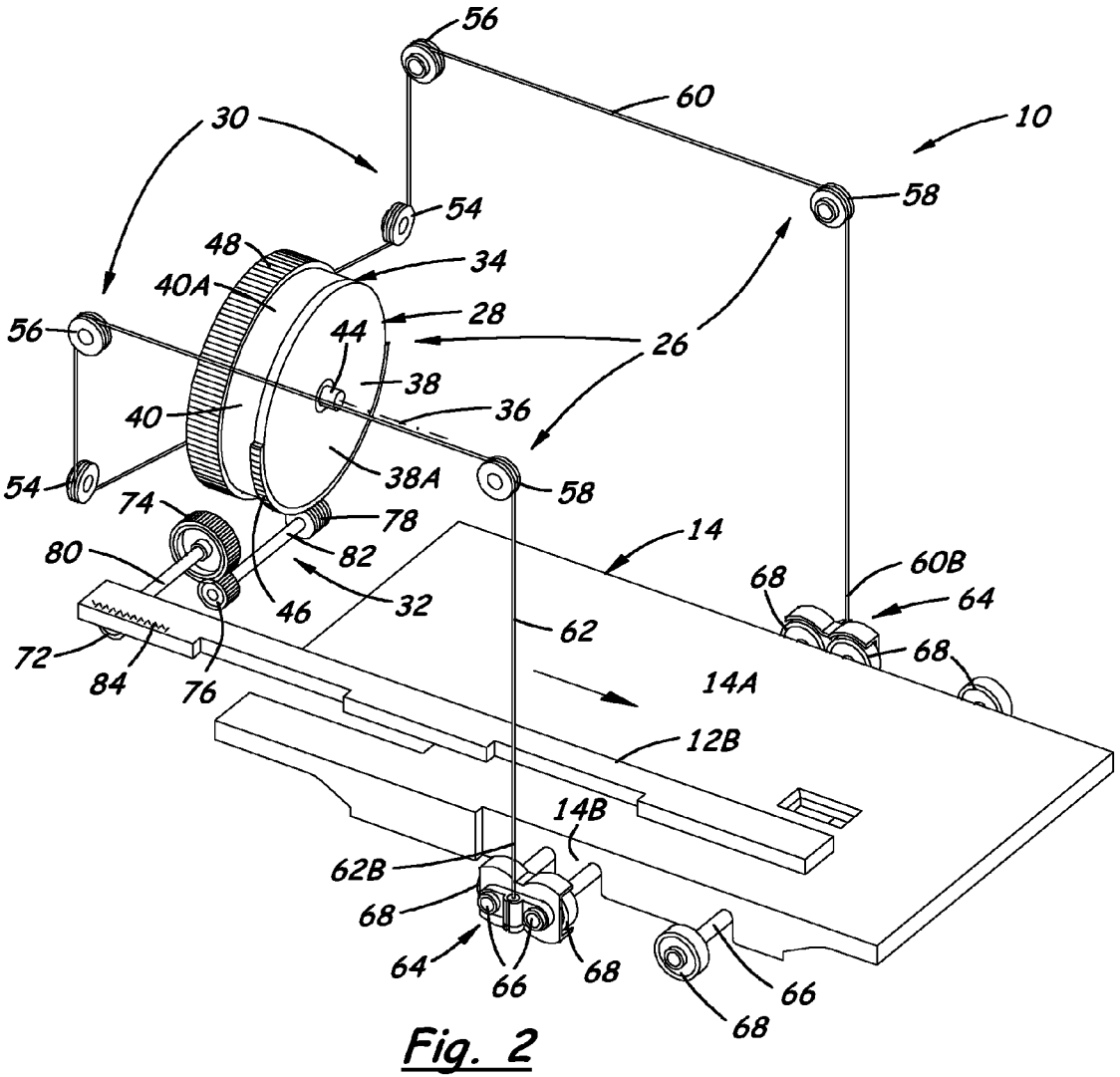

FIG. 2 is a schematic representation of a motion transmitting assembly of the media handling system, with the bin omitted, as employed with the platform and the movable bin of FIG. 1 in accordance with the present invention and as employed with the platform and a low torque motor (not shown) and its associated gears (not shown) in accordance with the invention of the cross-referenced patent application.

Figure 3:
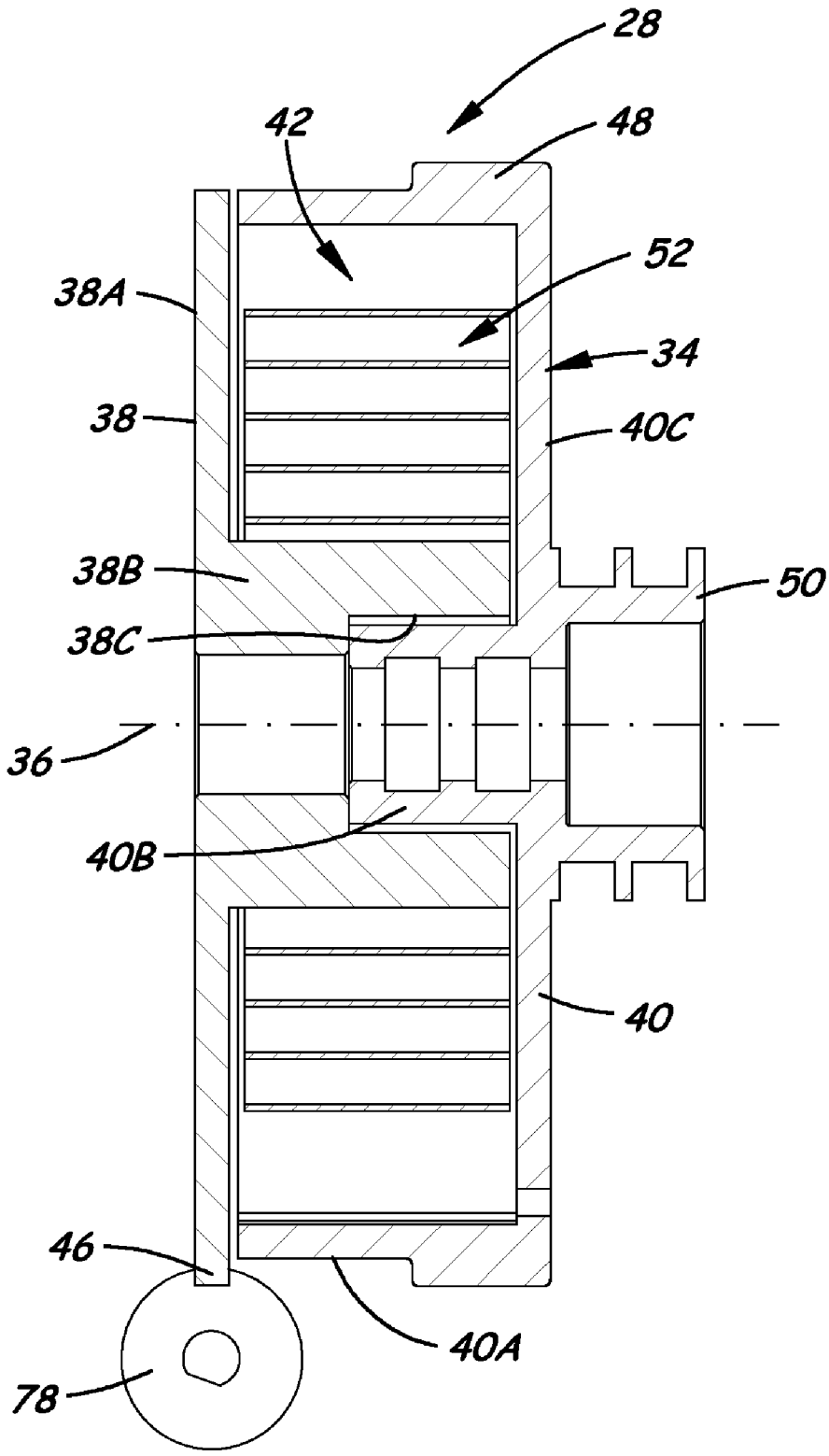

FIG. 3 is an enlarged vertical sectional view of a spring mechanism of the motion transmitting assembly of FIGS. 1 and 2 with the spring mechanism being shown alone.

Figure 4:
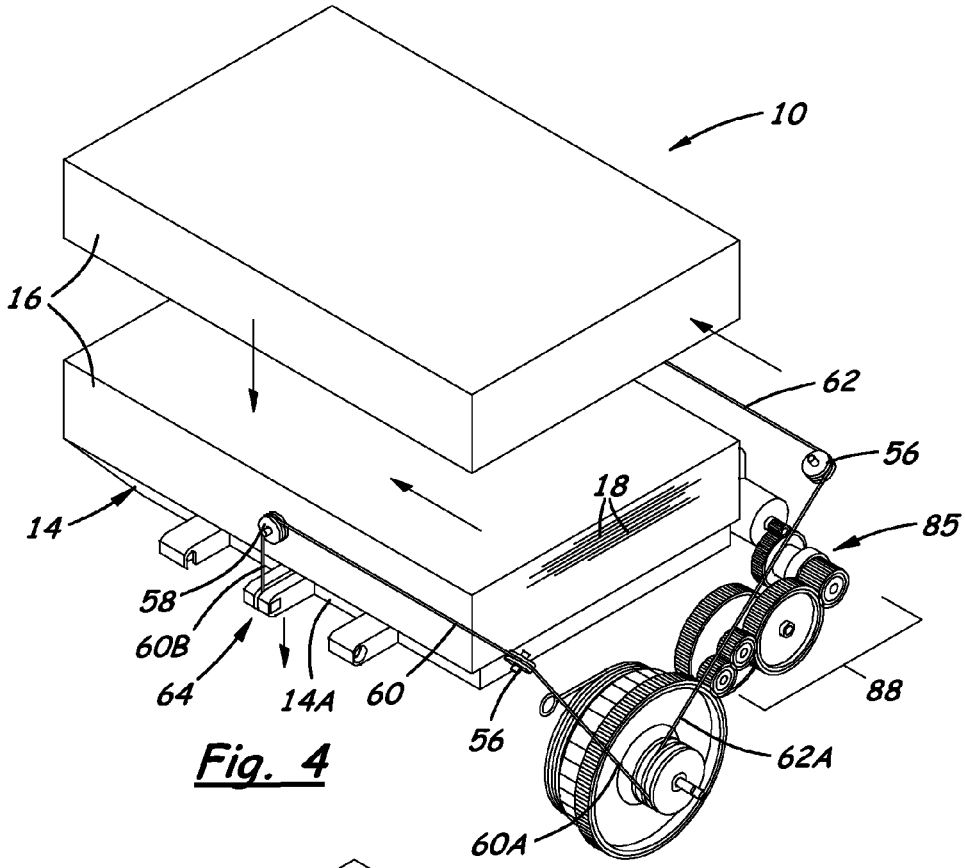

FIG. 4 is a schematic representation of the spring mechanism and rest of the motion transmitting assembly as employed with the platform and when uncoupled from the low torque motor (not shown) in accordance with the invention of the cross-referenced patent application.

Figure 5:
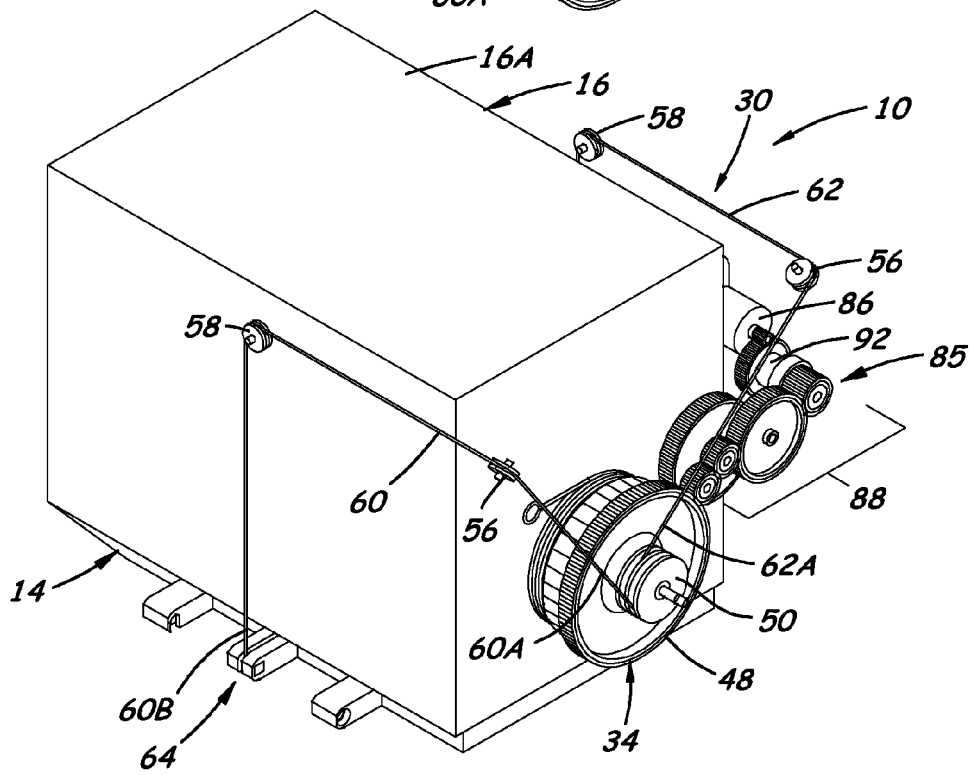

FIG. 5 is a schematic representation of the spring mechanism and rest of the motion transmitting assembly as employed with the platform and when coupled with the low torque motor in accordance with the invention of the cross-referenced patent application.

Figure 6:
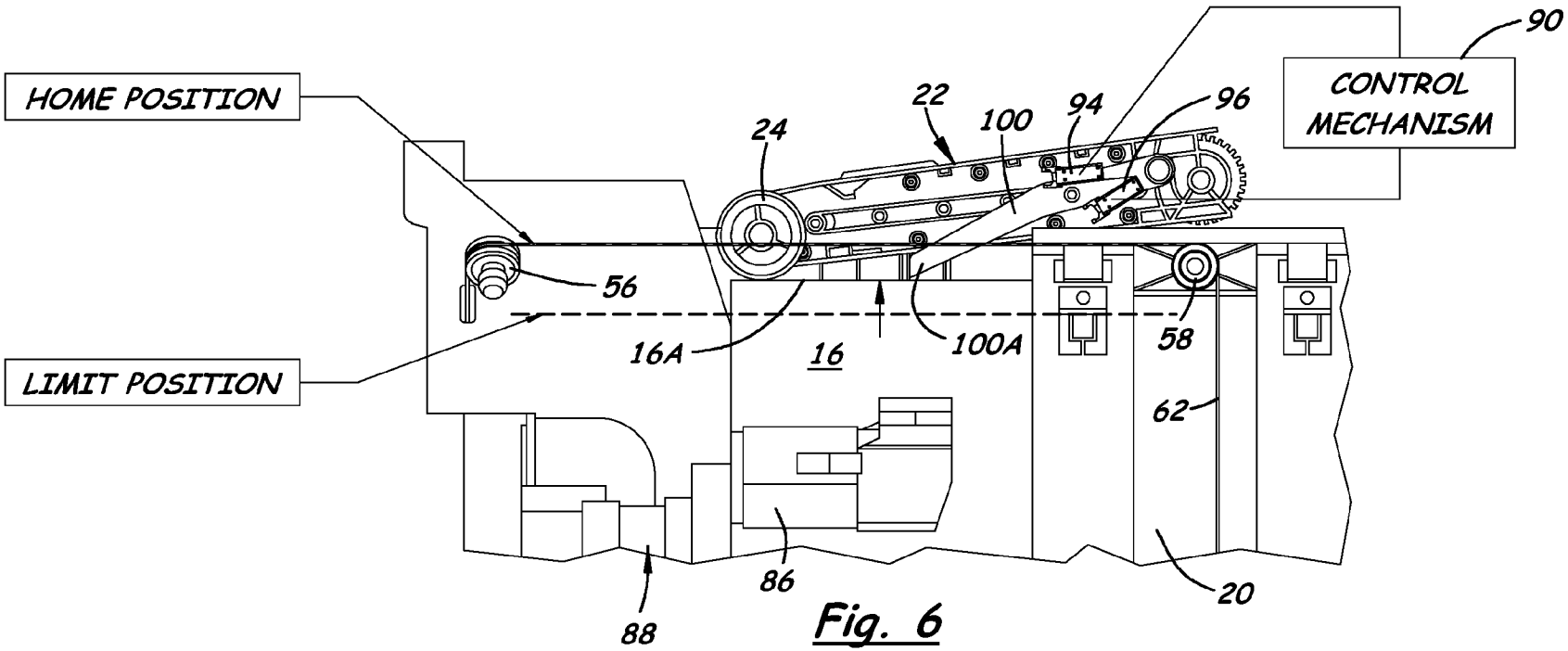

FIG. 6 is a schematic representation of the media stack in the bin of the media handling system in relation to the pick mechanism and sensors showing the top of the stack within a given range of upper home and lower limit operating positions of the pick mechanism.

Figure 7:
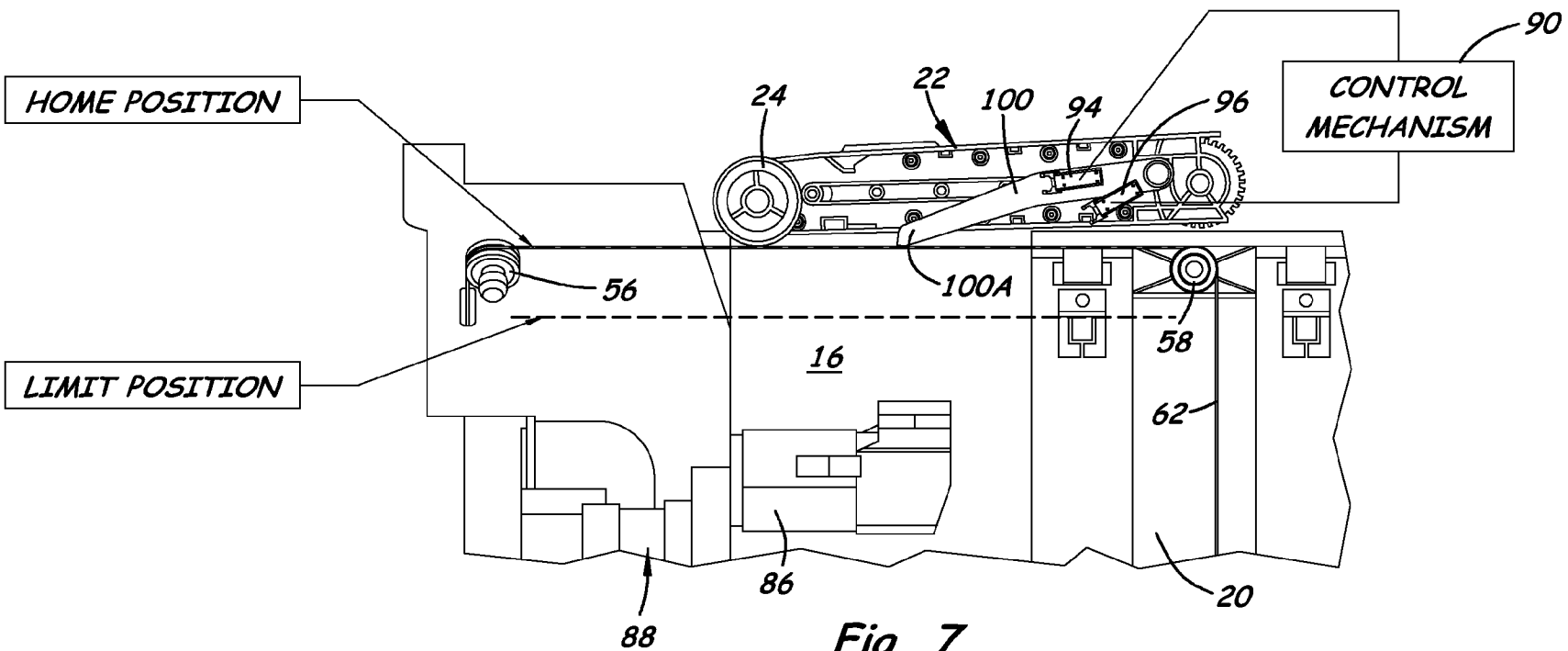

FIG. 7 is a schematic representation of the media stack similar to that of FIG. 6, but now showing the top of the stack at the upper home operating position of the pick mechanism.

Figure 8:
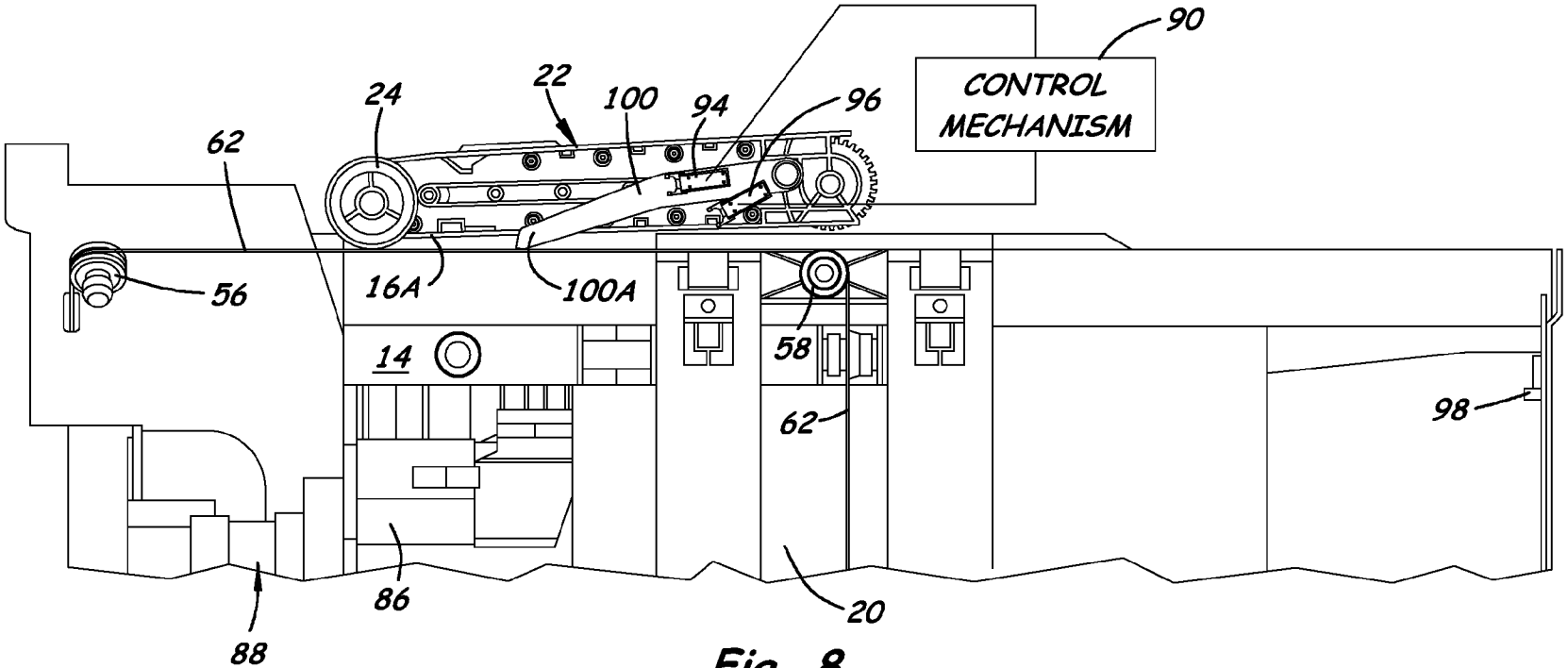

FIG. 8 is a schematic representation of the media stack similar to that of FIG. 7, but now showing the remainder of the media stack within the home and limit operating positions of the pick mechanism and the platform having reached its uppermost point of travel.

Figure 9:
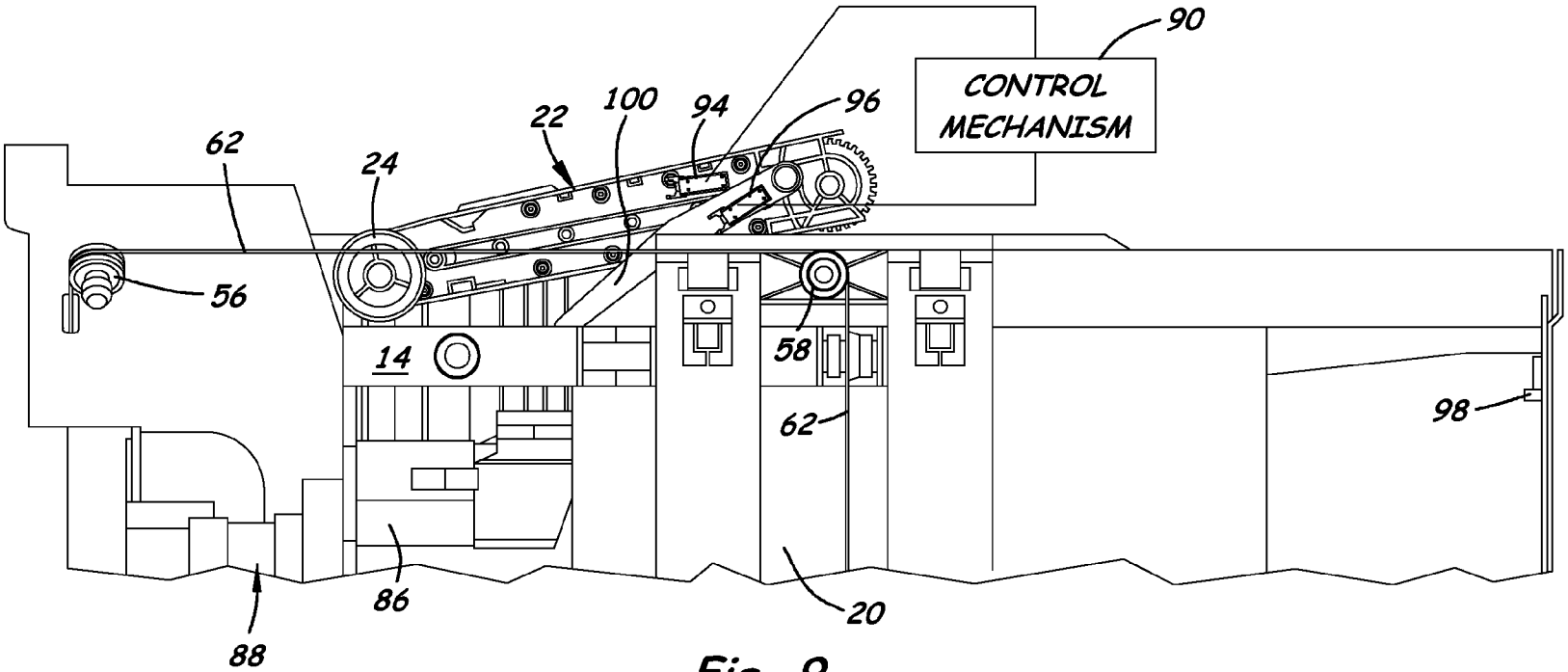

FIG. 9 is a schematic representation of the pick mechanism with its feed roll resting on the platform after having removed all sheets in the media stack from the platform.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Conversion of Movement of Bin into Movement of Stack Platform

Referring now to FIGS. 1 and 2, there is illustrated a media handling system 10, in accordance with the present invention, for an image forming machine (not shown). The system 10 includes a stationary frame 12 (only fragmentary portions of which are shown in the form of drawer slides 12A and a frame member 12B), an elevator tray or platform 14 supporting a stack 16 of media sheets 18 thereon, and a drawer or bin 20 supporting the platform 14 and in turn supported on the stationary frame 12 for undergoing movement relative thereto between first and second positions, such as internal and external of the image forming machine. In moving to the first position relative to the stationary frame 12, the bin 20 causes relocation or movement of the platform 14 to just below and closely adjacent to a given range of sheet feeding positions (see FIGS. 6-9) of, and in alignment with, a pick mechanism 22 of the machine which, as shown in FIGS. 6-9, can occupy those sheet feeding positions. The pick mechanism 22 has a feed roll 24 engageable with the top 16A of the media stack 16 and operable to feed media sheets 18 one at a time from the system 10 to an image forming operation of the machine when the feed roll 24 is engaged with the top 16A of the stack 16 at those positions. As will be described hereinafter, the platform 14 is movable relative to the bin 20 toward and away from the pick mechanism 22. In moving to the second position relative to the stationary frame 12 shown in FIG. 2, the bin 20 displaces the platform 14, in effect, both downwardly in the bin 20 and horizontally with the bin 20 away from and out of alignment with the sheet feeding position of the pick mechanism 22 and thus externally of the image forming machine where the platform 14 is accessible to a user to reload or replenish it with media sheets, such as seen in FIG. 4.

The media handling system 10 also includes a first motion transmitting assembly, generally designated 26, coupled between the stationary frame 12, platform 14 and bin 20 and operable to convert the movement or motion of the bin 20 between the aforementioned first and second positions relative to the stationary frame 12 into movement or motion of the platform 14 relative to the bin 20 toward and away from the sheet feeding position(s) which the feed roll 24 of the pick mechanism 22 may occupy. The motion transmitting assembly 26 includes a spring mechanism 28, depicted in detail by itself in FIG. 3 and shown as part of the assembly 26 in FIGS. 1, 2, 4 and 5. The assembly 26 also includes a plurality of flexible members and rotatable guide elements, referred to hereinafter as a first component group 30, and a plurality of gears and shafts, referred to hereinafter as a second component group 32.

Referring now to FIGS. 1-5, generally speaking, the spring mechanism 28 is tailored to counterbalance the weight of the platform 14 and of any stack thereon in response to the position of the bin 20 relative to the stationary frame 12. In order to maintain the counterbalanced relationship, the spring mechanism 28 converts movement of the bin 20 relative to the stationary frame 12, between the first and second positions, into storing of mechanical energy within the spring mechanism 28 and also into movement of the platform 14 relative to the bin 20 toward and away from the sheet feeding position of the pick mechanism 22, in proportion to the weight of a media stack 16 on the platform 14. The lesser the weight of any stack 16 on the platform 14 the lesser the energy that is stored by the spring mechanism 28 and the greater the movement of the platform 14 and vice versa the greater the weight of the stack 16.

As best seen in FIG. 3, in an exemplary embodiment the spring mechanism 28 includes a hoist drum 34 defining a central axis 36 and having a first drum part 38 and a second drum part 40. The first drum part 38 has a disc portion 38A and a central hub portion 38B integrally connected to and extending axially from one side of the disc portion 38A. The second drum part 40 has a cylindrical-shaped cover portion 40A and a central hub portion 40B which is adapted to fit within a bore 38C defined in the central hub portion 38B of the first drum part 38 such that the first and second drum parts 38, 40 are disposed close together so as to define an annular cavity 42 therebetween concentric about the central axis 36. The first and second drum parts 38, 40 are so mounted to one another that they can undergo rotation relative to one another and about a shaft 44 which is mounted along the central axis 36 to and protrudes from an end 20A of the bin 20. The disc portion 38A of the first drum part 38 has an outer gear section 46 formed thereon concentric about the central axis 36. The cover portion 40A of the second drum part 40 has an outer circumferential row of gear teeth 48 formed about it outwardly of a plate section 40C of the cover portion 40A and a reel 50 integrally formed and centrally located on the outer side of the plate section 40C of the cover portion 40A on an opposite side of the hoist drum 34 from the end 20A of the bin 20.

The spring mechanism 28 also includes a spring device 52 disposed in the annular cavity 42. The spring device 52 may take the form of a spiral leaf spring having opposite ends respectively connected to the first and second drum parts 38, 40 of the hoist drum 34. Alternatively, the spring device 52 also may take the form of a scrolled flat steel plate, torsion wound circular wire or other suitable constructions that are well-known to those of ordinary skill in the art. In any event, the spring device 52 functions together with the first and second component groups 30, 32 and the outer gear section 46 and the reel 50 on the hoist drum 34 to maintain the counterbalanced relationship between the position of the bin 20 relative to the stationary frame 12 and the position and weight of the platform 14 relative to the bin 20. When the platform 14 is either empty or loaded with the stack 16 of media sheets 18, the spring device 52 through the first component group 30 lifts the platform 14 and media stack 16 thereon so that the top 16A of the stack 16 is maintained at a level just below the lower limit position (see FIGS. 6 and 7) of the feed roll 26 of the pick mechanism 24 that picks the topmost sheet 18 from the stack 16. More particularly, the spring device 52 is resiliently yieldable so as to be windable and unwindable to the varying degree that maintains a wound condition biased toward unwinding and tailored to counterbalance the weight of the platform 14 and any stack 16 thereon such that as the weight decreases the platform 14 is lifted by the first motion transmitting assembly 26 toward the pick mechanism 22 so as to maintain the top 16A of the stack 16 at the position below and closely adjacent to the lower limit position.

As seen in FIGS. 1, 2 and 4-9, the first component group 30 in the first motion transmitting assembly 26 includes the plurality of rotatable guide elements in the form of sheaves or pulleys 54-58 and the plurality of flexible members in the form of cables 60, 62, such as cords, ropes, wires or the like, which taken together form flexible hoist lines of a hoist that includes the hoist drum 34. The flexible cables 60, 62 are attached at one of their ends 60A, 62A to the reel 50 of the spring mechanism 28 and extend in opposite directions therefrom between the spring mechanism 28 and opposite sides 14A, 14B of the platform 14 passing over and around the pulleys 54-58 that are rotatably mounted at various stationary locations on the exterior of the bin 20. The cables 60, 62 are adapted to transmit and release the application of lifting forces (mechanical energy of the spring mechanism 28) on the opposite sides 14A, 14B of the platform 14 from the spring mechanism 28.

The first motion transmitting assembly 26 further has a stabilizer shaft subassembly 64 mounted across an underside of the platform 14. The stabilizer shaft subassembly 64 includes shafts 66 with bearing elements 68 disposed on the opposite ends of the shafts 66 adjacent to the opposite sides 14A, 14B of the platform 14. The other ends 60B, 62B of the flexible cables 60, 62 are attached to the stabilizer shaft assembly 64 adjacent to the opposite sides 14A, 14B of the platform 14. The bin 20 has vertical channels 70 formed in the opposite sides 20B, 20C of the bin 20 adapted to receive the bearing elements 68 of the stabilizer shaft assembly 64 in the channels 70 and guide the bearing elements 68 in their movement between upper and lower ends of the channels 70 as the lifting forces are transmitted to and released at the opposite sides 14A, 14B of the platform 14.

The second component group 32 in the first motion transmitting assembly 26, the plurality of gears 72-78 and shafts 80, 82, couples the outer gear section 46 of the first drum part 38 of the hoist drum 34 with a gear rack 84 on the frame member 12B of the stationary frame 12. With such coupled arrangement, motion of the bin 20 relative to the stationary frame 12 between the first and second positions is transmitted through the aforementioned second component group 32 to the first drum part 38 of the hoist drum 34 to where the motion is converted by the spring device 52 into motion that is transmitted through the aforementioned first component group 30 to the opposite sides 14A, 14B of the platform 14.

To recap the present invention, the bin 20 can be moved in and out of the main body or frame 12 of the machine by its attachment to the drawer slides 12A. A stack 16 of sheets 18 are placed on the tray or platform 14 in the bin 20 which can move vertically in the bin 20 with the stabilizer shaft subassembly 64 as its guide. One ends 60A, 62A of the lifting cables 60, 62 are attached to the reel 50 of the hoist drum 34 and the other ends 60B, 62B of the lifting cables 60, 62 are attached to the opposite sides 14A, 14B of the platform 14 through the stabilizer shaft subassembly 64. The spiral spring device 52 inside the hoist drum 34 tends to rotate the drum 34 in the opposite direction of the weight of the platform 14 and stack 16 thereon or upward. Thus, in this arrangement, the platform 14 is always biased towards the top of the bin 20. The hoist drum 34 and the second component group 32, made up of the gears 72-78 and shafts 66, 68, together with the gear rack 84 can be viewed together as a spring booster assembly. Except for the gear rack 84 which is normally connected to the main body or frame 12 (via the frame member 12B) of the machine, all these other parts of the assembly 26 are mounted on the bin 20. When the bin 20 is moved in or out of the frame 12, gear 72 rotates against the stationary gear rack 84. The angular displacement of the gear 72 is transmitted to the hoist drum 34 via the intervening gears 74-78 and shafts 80, 82. For example, when the bin 20 is moved outward away from the machine, the hoist drum 34 is rotated accordingly and releases force (stored mechanical energy) against the spiral spring device 52 causing it to unwind inside the hoist drum 34. This in turn causes (or allows) the platform 14 and any stack 16 thereon to move lower down and avoid interfering with other parts, primarily, of the pick mechanism 22. On the other hand, when the bin 20 is moved toward and into the main body or frame 12, the hoist drum 34 is rotated in the opposite direction and causes the spiral spring device 52 to wind and tighten and thereby lift the platform 14 and the stack 16 thereon until counterbalance is attained.

The force on the spiral spring device 52 is "sized", or tailored, so that the top 16A of the media stack 16 is always lifted to a level just below the elevation of the lower limit of the feed roll 24 of the pick mechanism 22 where the feed roll 24 does not engage the stack top 16A. The media handling system 10 has additional "motive power-based" components, which will be described next relative to the invention of the cross-referenced patent application, that function together with the above-described "spring assist lift" components of the system 10 of the present invention, to boost movement of the platform 14 and stack 16 the remainder of the distance upward into engagement with the feed roll 24 of the pick mechanism 22 and also be able to resist the downward force on the stack 16 by the feed roll 24 during sheet feeding operations.

Maintenance of Stack Top Within Given Range of Pick Positions

Turning now to FIGS. 4-9, there is illustrated the additional "motive power-based" components of the media handling system 10 as well as the "spring assist lift" components as previously described hereinabove. These additional components of the system 10 which constitute a second motion transmitting assembly 85 include a low torque drive motor 86, preferably electrically operated, and a gear train 88 which drivingly couples the drive motor 86 with the circumferential row of gear teeth 48 on the cover portion 40A of the second drum part 40 of the spring mechanism hoist drum 40 of the first motion transmitting assembly 26. The provision of the "spring assist lift" components to elevate the platform 14 and stack 16 through most of the vertical distance, as described hereinbefore, serves to minimize the additional distance of upward vertical travel the platform 14 has to undergo with the aid of the drive motor 86 and gear train 88 to touch the feed roll 24 of the pick mechanism 22 and, hence, minimizes the electrical energy consumption requirements of the system 10.

Thus, the invention of the cross-referenced patent application is directed to this additional "low power requirement" capability of the media handling system 10, due to the implementation of the drive motor 86 and gear train 88 of the second motion transmitting assembly 85 and a control mechanism 90 combined with the above-described spring assist lift components (spring mechanism 28 and first and second component groups 30, 32 of the first motion transmitting assembly 26), in maintaining the top 16A of a relatively large stack 16 of media (i.e., greater than 500 sheets) within a given range or operating window of the pick mechanism 22, as seen in FIGS. 6-9. The control mechanism 90 which will be described in detail below utilizes sensors to indicate the position and status of the media stack 16 with respect to the operating window of the media handling system 10.

As illustrated in FIGS. 4 and 5, periodically or intermittently, the drive motor 86 of the assembly 85, which is mounted to the frame 12, will be detached from the gear train 88, which is mounted to the bin 20, at a suitable point in the gear train 88. A one-way clutch 92 is interposed between the drive motor 86 and spring mechanism 28 so as to restrict the drive motor 86 to only drivingly rotate the gear train 88 is one direction, that being, the direction that causes lifting of the platform 14. The spring mechanism 28 is normally at or near rest state when no media is present on the platform 14. To load media on the platform 14, the bin 20 is slidably moved to the external position from the internal position to remove the platform 14 from the operating environment. This automatically disconnects the gear train 88 from the drive motor 86. The media handling system 10 takes advantage of the media weight by using it to energize the counterbalance spring mechanism 28 by causing the spiral leaf spring 52 to be wound tighter.

Referring to FIG. 4, media sheets (normally in reams) are shown being loaded onto the platform 14. The vertically movable platform 14 supporting the media stack 16 pulls downward on the cables 60, 62 coupled to the hoist drum 34 via the reel 50. Thus, the loading process winds the spiral leaf spring 52 tighter so that it stores mechanical energy and will be ready to use it for lifting the platform 14 and media stack 16. The loading of the media stack 16 forces the platform 14 to move down until force equilibrium is attained between the media stack 16 and the spring mechanism 28. This process is repeated until the bin 20 is filled. Then the bin 20 with the platform 14 loaded with the media stack 16 is moved from the external position back to the internal position which automatically re-couples the gear train 88 to the drive motor 86. The spiral leaf spring 52 of the spring mechanism 28 is designed so that with the lightest media type supported on the platform 14, the media stack 16 is exerting slightly more force compared to the spiral leaf spring 52. The delta between the spring energy and the media weight along with various resistances (frictional drag) in the system 10 will be the resulting load that the low power drive motor 86 will have to carry to lift the load to the operating level.

Referring to FIG. 5, the stabilized vertically movable platform 14 inside the bin 20 (not shown) is loaded with the media stack 16 and has been moved with the bin 20 back to the internal position in the system 10 where the drive motor 86 is re-coupled to the gear train 88 and the topmost sheets 18 from the media stack 16 can be fed to the image forming machine by the pick mechanism 22, as seen in FIGS. 6-9. It has been described earlier how the various components of the first motion transmitting assembly 26 supported on the bin 20, in turn, support the platform 14 on the bin 20 and control its vertical motion relative to the bin 20. The hoist drum 34 doubles as a gear due to the presence of the circumferential row of gear teeth 48 about its peripheral at which it is connected the gear train 88 leading to the lower power drive motor 86. As sheets 18 are fed from the stack 16, the stack 16 will start to lose its accumulated weight. This causes the spiral leaf spring 52 in the spring mechanism 28 to unwind from its coiled state for the mechanical system to come to equilibrium. This reaction coupled with the torque generated by the motor-driven gear train 88 is utilized by the system 10 to index the stack 16 upward to the top of the controlled operating position, or the HOME position, in FIG. 6, once the sensors of the control mechanism 90 sense that the media stack level has reached the minimum, or LIMIT position, of the operating level. This happens with the unwinding spiral leaf spring 52 assisting the drive motor 86 to wind the cables 60, 62 around the reel 50 of the hoist drum 34 thereby raising the vertically movable platform 14. This indexing process is repeated until the large stack 16 is consumed and the platform 14 of the system 10 is ready for another load of media.

Referring to FIGS. 6-9, there is also shown the functioning of the control mechanism 90 which can be a controller to control operations. Control is accomplished by the use of sensors to give feedback on the status of the media stack 16 within the bin 20. The control mechanism 90 operates with four sensors 94-98 and a flag 100. For example, the sensors 94, 96 can be in the form of photo-interrupters or other electro-mechanical switches. The flag 100 may be a mechanical device which affects the state of the sensors 94, 96 by having elements thereon which act as shutters which switch, via blocking and non-blocking of, the sensors 94, 96 between off and on states by virtue of the pivotal position of the flag 100 in response to the media stack height. The first and second sensors 94, 96 monitor the status of the media stack 16; the third sensor 98 monitors the vertically movable platform 14; and a fourth sensor (not shown) monitors the media bin 20. When the platform 14 is loaded with media, as seen in FIG. 6, the top 16A of the full media stack 16 is always below the HOME position of the system 10. As the bin 20 is slideably installed into operational engagement, the media bin presence or fourth sensor tells the media handling system 10 that the bin 20 is in operational engagement. This signal, together with signals from the first and second media level sensors 94, 96, from activation by the flag 100, indicate that the media level is below the HOME position, thereby triggering the drive motor 86 to turn, lifting the media stack 16. Once the media level sensors 94, 96 indicate that the media stack 16 is at HOME position, the drive motor 86 is switched off and the media handling system 10 is now ready to start feeding sheets 18 into the image forming machine or an intermediate module that feeds the sheets into the machine.

Referring now to FIG. 7, one of the drive gears near the drive motor 86 and before the point of its disengagement has the one-way clutch 92 that locks the drive motor 86 so as to allow only the upward motion of the platform 14 when the control mechanism 90 is in operational engagement. The one-way clutch 92 prevents any downward movement of the platform 14 when the feed roll 24 of the pick mechanism 22 is picking sheets. The vertically movable platform 14 is only allowed to move down when the bin 20 is removed from the internal position, the site of operational engagement, to the external position, the site for loading of media. When feeding sheets of media with the feed roll 24 of the pick mechanism 22, the vertically moveable platform 14 does not move up due to the drive motor 86 being turned off, until such time the media supply within the operational feeding level is exhausted and the media level flag 102 activates the first and second media level sensors 94, 96 to indicate this condition (LIMIT position) or a set number of sheets have been picked. The drive motor 86 is turned on until the flag 100 activates the first and second media level sensors 94, 96 to indicate that the stack has reached HOME position.

Turning now to FIGS. 8 and 9, throughout the operation of the feed roll 24 of the pick mechanism 22, the media stack level is only allowed to fall within the HOME and LIMIT positions. This operating window allows for lesser wear on paper path components such as wear strips and takes advantage of the flexibility of having a pick mechanism 22 with a pivotal pick arm 102 mounting the feed roll 24 as to a fixed pick mechanism. The indexing process is repeated as deemed necessary until the whole stack of media sheets have reached the LOW state, as seen in FIG. 8. The LOW state is a condition wherein the media stack is within the HOME and LIMIT positions and the stabilized vertically movable platform 14 has reached its topmost point of motion. At this point, the third sensor 98 which monitors the vertically movable platform 14 is tripped and the drive motor 86 is prevented from further rotation. As the picking process continues to the last sheet as seen in FIG. 9, the front tip 100A of the media level flag 100 drops into a hole (not shown) in the platform 14 as soon as the trailing edge of the last sheet leaves contact with the media level flag 100. The media handling system 10 is then notified that it is empty and operation is suspended until a fresh load of media is inserted into the bin 20.

To recap, in accordance with the invention of the cross-referenced patent application, by utilizing the spring assist lift components to counterbalance the accumulated weight of the media stack 16 and vertically movable platform 14 on which the stack rest, the drive motor 86 with only a low torque or power rating together with the gear train 88, the one-way clutch 92 and the sensors 94-98 and flag 100 of the control mechanism 90 are sufficient to achieve the added lifting of the media stack 16 to the HOME position of the operating feed roll 24 of the pick mechanism 22. Thus, the addition of a separate power supply for the system 10 is not required. The control mechanism 90 regulates the movement of the platform 14 within the given range of the pick mechanism 22, between the LIMIT and HOME positions, in order to actively control the position of the top 16A of the media stack 16 according to the operating conditions desired. The desired operating conditions are a relatively reasonable operating window of media type and weight which may include, by way of example but not limitation, A4 to LGL sheet sizes and 20 to 32 lb sheet weights. It should be noted that the use of the type of spring device 52 as contemplated herein does not require any adjustment to support the varying media sizes and weights.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A media handling system for an image forming machine, comprising:

a stationary frame;

a platform for supporting a stack of media sheets thereon;

a bin movable relative to the stationary frame, the bin supporting said platform and in turn supported on said stationary frame, the bin undergoing movement relative to said stationary frame between a first position in which said bin locates said platform below and aligned with a sheet feeding position and movable relative to said bin toward and away from said sheet feeding position and a second position in which said bin displaces said platform away from and out of alignment with said sheet feeding position; and a motion transmitting assembly coupled between said stationary frame, platform and bin and operable to convert movement of said bin between said first and second positions relative to said stationary frame into movement of said platform relative to said bin toward and away from said sheet feeding position, said motion transmitting assemble including a spring mechanism being windable and unwindable to maintain a wound condition biased toward unwinding and tailored to counterbalance the position and weight of said platform and any stack thereon relative to said bin and the position of said bin relative to said stationary frame such that said spring mechanism in maintaining said counterbalance converts movement of said bin relative to said stationary frame between said first and second positions into movement of said platform relative to said bin toward and away from said sheet feeding position, said spring mechanism including:

a hoist drum defining a central axis and having:

a first part rotatably mounted about said central axis to an end of said bin and having a gear section formed thereon concentric about said central axis, and a second part having a reel on an opposite side of said drum from said end of said bin and rotatably mounted to said first part so as to be rotatable relative thereto and define an annular cavity therebetween and concentric about said central axis; and a spring device disposed in said annular cavity and having opposite ends respectively connected to said first and second parts of the hoist drum, said spring device being resiliently yieldable so as to be windable and unwindable to maintain the wound condition biased toward unwinding and tailored to said counterbalance, the spring device comprising a spiral leaf spring having opposite ends respectively connected to the first and second parts of the hoist drum.

2. A media handling system for an image forming machine, comprising:

a stationary frame;

a platform for supporting a stack of media sheets thereon;

a bin having vertical channels in opposite sides, the bin movable relative to the stationary frame, the bin supporting the platform and in turn supported on the stationary frame, the bin undergoing movement relative to the stationary frame between a first position in which the bin locates the platform below and aligned with a sheet feeding position and movable relative to the bin toward and away from the sheet feeding position and a second position in which the bin displaces the platform away from and out of alignment with the sheet feeding position; and a motion transmitting assembly coupled between the stationary frame, the platform and the bin and operable to convert movement of the bin between the first and second positions relative to the stationary frame into movement of the platform relative to the bin toward and away from the sheet feeding position, the motion transmitting assembly including:

a spring mechanism comprising:

a hoist drum defining a central axis, the hoist drum comprising:

a first part rotatably mounted about the central axis to an end of the bin and having a gear section formed thereon concentric about the central axis; and a second part having a reel on an opposite side of the drum from the bin and rotatably mounted to the first part so as to be rotatable relative thereto and define an annular cavity therebetween and be concentric about the central axis; and a spiral leaf spring disposed in the annular cavity and having opposite ends respectively connected to the first part and second part of the hoist drum, the spiral leaf spring being resiliently yieldable so as to be windable and unwindable to maintain a wound condition biased toward unwinding and tailored to counterbalance the position and weight of the platform and any of the stack thereon relative to the bin and the position of the bin relative to the stationary frame such that the spring mechanism in maintaining counterbalance converts movement of the bin relative to the stationary frame between the first and second positions into movement of the platform relative to the bin toward and away from the sheet feeding position;

a plurality of flexible lines and corresponding pulleys forming a hoist, the plurality of flexible lines being attached at one of their ends to the reel of the spring mechanism and extending in opposite directions therefrom between the spring mechanism and the opposite sides of platform through corresponding ones of the plurality of pulleys and which transmit and release the application by the spring mechanism of lifting forces on opposite sides of the platform;

a plurality of shafts with bearing elements disposed on the opposite ends of the plurality of shafts adjacent to the opposite sides of the platform such that the ends of the plurality of flexible lines are coupled to the plurality of shafts with bearing elements adjacent to opposite sides of the platform wherein the vertical channels of the bin receive the bearing elements of the plurality of shafts and guide the bearing elements in moving between the upper and lower ends of the vertical channels as lifting forces are transmitted to and released from the opposite sides of the platform; and a plurality of gears and shafts coupling the gear section of first part of the hoist drum and a gear rack on the stationary frame such that motion of the bin relative to the stationary frame between the first and the second positions is transmitted through the plurality of gears and shafts to the first part of the hoist drum to where motion is converted by the spring device into motion that is transmitted through the plurality of flexible cables and pulleys to opposite sides of the platform.

* * * * *